United States Patent [19]

Dawson et al.

[11] 3,963,635

[45] June 15, 1976

[54] DISHWASHING COMPOSITIONS

[75] Inventors: Peter Leonard Dawson, Chester; Michael Tom Rothwell, Bromborough, both of England

[73] Assignee: Lever Brothers Company, New York, N.Y.

[22] Filed: Oct. 1, 1973

[21] Appl. No.: 402,420

[30] Foreign Application Priority Data

Oct. 16, 1972 United Kingdom ..... 47675/72

[52] U.S. Cl. ..... 252/142; 252/550; 252/554; 252/558; 252/559

[51] Int. Cl.[2] ..... C11D 7/08; C23G 1/02

[58] Field of Search ..... 252/142, 143, 533, 535, 252/536, 537, 539, 551, 552, 553, 554, 555, 556, 558, 89, DIG. 11, DIG. 14, DIG. 17

[56] References Cited

UNITED STATES PATENTS

| | | | |
|---|---|---|---|
| 2,874,124 | 2/1959 | Vitalis | 252/539 |
| 3,032,578 | 5/1962 | MacMullen | 252/DIG. 17 |
| 3,462,520 | 8/1969 | Nehmsmann | 252/DIG. 17 |
| 3,513,099 | 5/1970 | Hans et al. | 252/553 |

OTHER PUBLICATIONS

Phosphate Surfactants—Properties & Uses, Mayhew et al., "Soap & Chemical Specialities", Apr. & May 1962, pp. 55-58,93,95,80,81,167,169.

GAFAC Surfactants, "GAF Technical Bulletin 7543-094", 1960.

GAFAC, "GAF Technical Bulletin AP145", 1964.

*Primary Examiner*—William J. Van Balen
*Assistant Examiner*—William R. Dixon, Jr.

[57] ABSTRACT

A dishwashing composition which can be used in the conventional manner to obtain good foaming and detergency and can also be used in dilutions of about 5:1 or less to obtain a non-stick effect on aluminium pans contains from 10–50% of a detergent of which from 5–40% is a calcium/magnesium sensitive anionic synthetic detergent, from 0.01–2% of a selected alkyl phosphate monoester, and from 1 to 40% of a solubilizer.

An example of such a composition has the following formulaton:

| | % |
|---|---|
| Sodium dodecyl benzene sulphonate | 30.0 |
| Ammonium $C_{12}$–$C_{15}$ primary alcohol 3EO sulphate | 8.0 |
| Lauryl phosphate (12%) | 0.5 |
| Succinic acid | 1.5 |
| Glutaric acid | 1.0 |
| Ethanol | 6.0 |
| Urea | 6.0 |
| Water and ammonia to pH 5 | balance |

6 Claims, No Drawings

DISHWASHING COMPOSITIONS

Our earlier patent application, Ser. No. 25920/70 describes compositions for dishwashing which impart temporary protective films to the surfaces of aluminium and aluminium alloy cooking utensils, during the hand dishwashing operation, conventionally in a bowl, at a dilution of ~ 500 times. The films, of the order of one or two molecules thickness are formed on the metal surfaces by reaction between the metal, or metal oxide, layer and specific molecules in isotropic aqueous solution. These films have been shown to facilitate to a remarkable degree the subsequent washing/cleaning of pans etc. used for cooking proteinaceous foods such as scrambled egg, porridge and soup, fried sausages and eggs.

The film is termed "anti-resoiling" and the agents responsible therefor are termed "anti-resoiling agents". The handwashing compositions of our earlier application, which exhibit the high foam level and foam stability in presence of food necessary for consumer acceptance, as well as the anti-resoiling properties, consist substantially of a anionic synthetic detergent and a defined anti-resoiling agent. The agents specifically described in our earlier application are surface active organic phosphorus compounds as listed therein; these were described in conjunction with a solubiliser for the agents. Suitable hand dishwashing compositions, for the ~ 500× dilution, for use in all naturally occurring waters, according to our earlier application, comprised:

1. the anti-resoiling agent;
2. A solubiliser for maintaining the anti-resoiling agent in aqueous solution and to assist in prevention of precipitation of the agent by calcium and magnesium ions in hard water;
3. an anionic synthetic detergent carefully selected for foam performance, cleaning and stability in acid conditions; and
4. a pH controller for the control of the in-use pH.

The minimum level of the anti-resoiling agent disclosed was in accordance with the bowl use of the compositions of the earlier invention, i.e. at a concentration of about 0.2% by weight of composition in water. This concentration occurs when the composition is diluted about 500 times; believed to be the dilution used by the majority of consumers for conventional dishwashing. The minimum level of anti-resoiling agent, in compositions effective when used in this way, corresponds to a concentration of agent in use, of about 0.002%. In the earlier application, it was appreciated that the anionic synthetic detergent needed careful selection, both as to type and as to amount relative to the anti-soiling agent, if the foaming and anti-resoiling properties were to be obtained in the dilute dishwashing operation. When the agent was one of the specified ethoxylated phosphates the ratio of anionic synthetic detergent to the agent was determined to lie from 15:1 to 3:1. When the agent was one of the specified nonethoxylated phosphates, this ratio lay from 20:1 to 3:1. In use at the above dilutions, of the compositions of the earlier application which employed the minimum level of agent, the above ratios of 20:1 and 15:1 could not be exceeded, if foam and anti-resoiling in all waters was to be obtained.

The present invention relates to hand dishwashing compositions which yield (a) defined foam performance and good detergency when used at ~ 500 times dilution and (b) cleaning and an anti-resoiling film on aluminium or aluminium alloy articles or utensils when used at greater concentrations than those of the earlier application, viz. at dilutions of ~ 5:1 and less. Use of a concentrated liquor is particularly useful when cleaning soiled pans, wherein it is accepted practice to add the dishwashing composition to a small amount of water in the pan itself, or even to use the composition neat. This pan washing practice makes greater control of conditions possible.

Compositions of the present invention are therefore designed for general use in conventional dishwashing, for use in the concentrated aqueous form, or for use alone for obtaining an anti-resoiling effect during cleaning/washing aluminium pans/cooking utensils. The compositions are economic and the benefit of an anti-resoiling effect in such pan washing is achieved in conjunction with a consumer-acceptable foam level and foam stability in the conventional highly dilute dishwashing operation. Thus, a single composition can be used to advantage when the two dilutions are adopted.

A further advantage lies in a low incidence of the loosely-adhering aluminium particles frequently encountered when aluminium pans are scrubbed/scoured in dilute dishwashing solutions. As the compositions of the invention can be used at high concentrations, this problem can be obviated.

Yet a further advantage lies in avoidance of highly acidic dishwashing liquors. The present compositions contain only low levels of acid, resulting in a "bowl pH" in the conventional dishwashing step of 6–8, depending upon the pH and hardness of the domestic water used.

Careful selection of the agent, solubiliser, anionic synthetic detergent and acid pH controller is required if these advantageous technical effects are to be achieved.

An "acceptable" foam performance is now believed to be at least 60% of the performance of a currently marketed "premium" product of 40% total active detergent material, consisting essentially of sodium dodecyl benzene sulphonate, sodium lauryl ether (3EO) sulphate and coconut monoethanolamide in the weight ratio 1:1:0.1, on any test method for foam and foam stability on an a.d. weight for weight basis. The preferred test for foam and foam stability in presence of food residues is a modified Schlachter-Dierkes test which is based on the principle described in Fette und Seifen, 1951, vol.53, p.207. A 100 ml aqueous solution of the dishwashing composition at 0.06% a.d. in water of 24°H at 45°C is rapidly agitated using a vertically oscillating perforated disc within a graduated cylinder. The initial foam volume is recorded.

0.2 g of soil (9.5 parts commercial cooking fat, one-fourth part oleic acid, one-fourth part stearic acid dispersed in 120 parts water, the emulsion stabilised with 10 parts of wheat starch) is added and the solution mildly agitated with the perforated disc for 10 seconds to disperse it. This is followed by a 5 seconds rest, after which a further aliquot of soil is added and the process repeated until the foam is exhausted, i.e. incomplete coverage of the surface of the solution by foam. The number of soil increments required to exhaust the foam is recorded. The control liquid gives a score of 50 ± 3 increments, and an initial foam of 240 ml. The incremental scores of the compositions of the present invention are expressed as a percentage of this and are consequently at least 30 increments.

The anti-resoiling effect can be tested as follows:

The inside surface of a 5" diameter aluminium pan is prepared by scouring in warm tap water with a non-woven nylon fleece impregnated with mineral abrasive until the surface is completely wetted by the water. The pan is then dried with a paper tissue, and soiled in the following manner:

25 ml of an egg/milk mixture of ratio 50:50 by volume is poured into the pan in the usual way. The mixture is cooked without stirring for 1½ minutes on an electric hot plate maintained at 200°–300°C. Under these conditions the egg/milk mixture leaves a coherent light brown residue adhering to the pan when the loose bulk of the cooked mixture has been scraped out with a wooden spoon.

The solution under test is introduced directly into the utensil (6 ml of a 30% w/w aqueous solution of the composition — this approximates to 2 mls composition in neat form added to a wet pan). The pan is then scoured clean (about 30–60 seconds) with the abrasive fleece, rinsed, dried and resoiled, with the egg/milk mixture.

The pan is then immersed in a 0.15% solution of the composition for 30 seconds and a soft polyurethane sponge is used to attempt complete removal in 15 seconds.

Compositions of this application will cause the egg-/milk residue to be removable with the sponge in 15 seconds or less following three or fewer treatment-/cooking cycles. The egg/milk mixture is selected for the anti-resoiling performance test because it is a soil known to be difficult to remove in hand dishwashing.

The compositions of the present application are effective in providing an anti-resoiling film when pans in which porridge, milk pudding, milk, fried eggs, sausages etc. or gravy has been cooked, are washed/-cleaned therewith. Equally, the film will be provided on pans which are relatively clean, e.g. those in which potatoes have been boiled.

Accordingly, the present invention provides a hand dishwashing and aluminium pan cleaning composition which comprises 10–50% total active detergent of which 5–40% is calcium/magnesium sensitive anionic synthetic detergent, 0–40% is anionic solubiliser, and 0–25% is nonionic solubiliser, the total solubiliser being at least 1.0%; 0.01–2% alkyl phosphate monoester as herein defined; 0–10% acid pH controller; the ratio of the total of the anionic synthetic detergent plus anionic solubiliser: alkyl phosphate monoester being as described below and the pH of the composition is not more than 7, percentages being by weight of total composition, and ratios being by weight.

Suitable dilutions in use are 10–50% by weight of the composition in water for pan washing and 0.1–0.2% for conventional bowl dishwashing.

Careful selection of the anionic synthetic detergent-/solubiliser is required in order that acceptable foaming properties at 500 times dilution and the anti-resoiling effect at high concentrations are obtained.

Suitable calcium and magnesium sensitive anionic synthetic detergents are alkali metal, ammonium or substituted ammonium derivatives of the $C_{11-18}$ alpha and random alkene sulphonates; random $C_{13}$–$C_{18}$ alkane sulphonates; $C_{10}$–$C_{15}$ alkyl benzene sulphonates; $C_{11}$–$C_{15}$ primary or secondary alcohol sulphates and binary or ternary mixtures, thereof. Commercial "olefin sulphonates" contain alkene sulphonate in conjunction with hydroxy alkane sulphonates and disulphonates. The first material is a calcium and magnesium sensitive anionic synthetic detergent, whereas the latter two are anionic solubilisers, as explained below.

It has been found essential to include a solubiliser for the alkyl phosphate monoester which is characteristically of limited aqueous solubility, so as to ensure that it is in solution during use. A solubiliser is particularly necessary in hard water use conditions. A solubiliser is defined as a surface active agent which will form clear solutions in hard water of 24°H at neutral pH in the temperature range 20°–45°C at concentration of 0.05% solubiliser. At least 1.0% by weight of the compositions of the present invention is a solubiliser. Suitable solubilisers are soluble nonionic or anionic compounds of medium to high HLB (WC Griffin, J Soc Cosmetic Chemists, 1, page 311, 1949). The following list indicates suitable materials.

Nonionic Solubilisers

1. Primary and secondary aliphatic acohols and vicinal diols of chain length of 10–16 carbon atoms with an average of 7–20 mols ethylene oxide per mol of alcohol/diol. 2. Alkyl phenols of alkyl chain lengths 8–12 carbon atoms with an average of 7–20 mols ethylene oxide per mol alkyl phenol.

Anionic Solubilisers

1. The alkali metal, ammonium or substituted ammonium hydroxyalkane sulphonates and disulphonates resulting from sulphonation of $C_{11-18}$ random and alpha-olefins. These are usually present in commercial "olefin sulphonate".

2. Alkali metal, ammonium or substituted ammonium $C_{11}$–$C_{15}$ primary or secondary alcohol ether ($\overline{1}$-$\overline{12}$ ethylene oxide) sulphates.

Preferred solubilisers are $C_{11}$–$C_{15}$ secondary alcohol $\overline{12}$ EO nonionic, $C_{11}$–$C_{15}$ secondary alcohol $\overline{7}$ EO sulphate, $C_{12}$–$C_{15}$ synthetic primary alcohol $\overline{3}$ EO sulphate, and the solubiliser component of commercial alpha- and random $C_{14}$–$C_{16}$ olefin sulphonates. These enhance the foam performance.

It has been found preferable that the pH of the "in pan" solution be less than 7; the efficiency of a given alkyl phosphate monoester anti-resoiling agent increasing as the in use pH is decreased to pH 5. Lower pH's do not appear to alter the efficiency significantly. pH's below ~ 2 should be avoided, as the aluminium surface may tend to dissolve.

It is believed that the effective adsorbing species of alkyl phosphate is

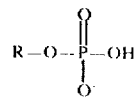

which is present in maximum amounts at ~ pH 5.

In order to obtain an "in-pan" solution pH of less than 7, preferably 4.0–5.5 at 10–50% by weight of composition in all naturally occurring waters, about 0.5–5% of the pH controller is required. The amount of pH controller depends upon the type of water encountered, the pH of the composition desired, and the acid reserve of the particular acid selected. Up to 10% may be required in certain cases. 1–3% is preferred.

In most cases, there is insufficient acid in the compositions to alter significantly the dilute washing solution pH from that of the naturally occurring water, and as such has only small effect upon the foam performance. Where the pH of the dilute solution is significantly lowered below 7, for example in soft waters, then the foam performance is increased.

Suitable acids, when used, are those having at least one pKa in the range 3–6. Preferred acids are malonic, succinic, glutaric, citric, tartaric, and lactic. Phthalic, adipic, fumaric and benzoic acids are less soluble and suitable for use in aqueous suspensions or pastes, or powders.

They may be used as mixtures or as single components in their acid form or partial alkali metal/ammonium/amine salts.

The alkyl phosphate monoesters defined as anti-resoiling agent are:

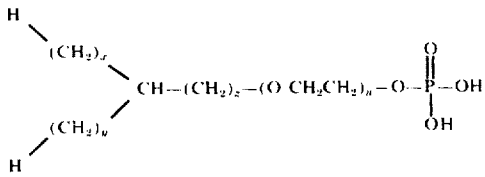

1.

wherein $x + y + z = 9–17$ $x,y$ or $z$ may be zero $n = 0$ or 1.

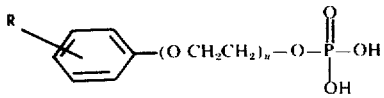

wherein

R is $C_8$–$C_{18}$ linear or branched mono- or di-alkyl substituent on the benzene ring, and $n = 0$ or 1.

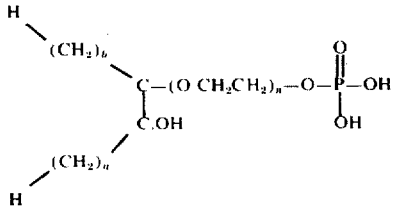

3.

wherein $a + b = 10–16$ $a$ or $b$ may be zero, and $n = 0$ or 1.

4. alkenyl analogues of the alkyl moieties described above (classes 1 – 3)

Suitable monoester phosphates are of the following alcohols:

1. Synthetic $C_{12}$–$C_{15}$ detergent alcohols containing ~ 75% linear primary alcohol and ~ 25% 2-Me primary alcohols.

2. Synthetic $C_{11}$–$C_{15}$ detergent alcohols containing linear random secondary alcohols.

3. Synthetic $C_{13}$–$C_{15}$ detergent alcohols containing 50% linear primary alcohol and 50% of 2-Me and 2-Et primary alcohols.

4. Lauryl, myristyl, palmityl alcohols.

5. $C_{11}$–$C_{16}$ linear random vicinal diols.

6. Oleyl alcohol and stearyl alcohol.

7. Octyl/nonyl phenol.

8. Dinonyl phenol.

9. The monoethoxylated adducts of the above alcohols 1–8. These are present in appreciable quantities (with or without the unethoxylated alcohols) in low EO (up to ~ (average $\overline{5}$ EO) nonionics based on these synthetic and natural alcohols.

These are selected on the basis of avoidance of interference at the surface of the aluminium with the anionic synthetic detergent and solubiliser.

They may be prepared by well-known processes using either $P_2O_5$, polyphosphoric acid or $POCl_3$ usually followed by a hydrolysis step with water. The mole ratios of alcohol or alcohol ethoxylate to phosphating agent are manipulated to give high monoester products. For instance a mole ratio of 2:1:1 fatty alcohol:-$P_2O_5$: water heated to 95°C for 8 hours gives a product containing about 70% monoester. Higher monoester contents can be obtained using $POCl_3$ followed by hydrolysis. Phosphation of secondary alcohols is a difficult process which is made somewhat easier when the monoethoxylated adduct is used instead.

The alkyl phosphate monoesters of the invention are used, preferably, in their mono salt form, i.e. sodium, potassium, ammonium or substituted ammonium half salts.

The polyethoxylated alcohol phosphate monoesters are suitable only when they contain the unethoxylated or monoethoxylated monoester, such as will yield a composition according to the invention, viz having at least 0.01% of the defined alkyl phosphate monoester, or monoethoxylated adduct.

Phosphate monoesters based on alcohols and their monoethoxylated derivatives of alkyl chain lengths less than 10 and greater than 18 give poor or no anti-resoiling properties in these systems due, respectively, to lack of sufficient surface activity, and limited aqueous solubility.

The weight ratios of the total of the anionic synthetic detergent and anionic solubiliser to the phosphate monoester when derived from a linear primary alcohol, and irrespective of ethoxylation, is 1500:1 to 30:1. When the monoester is derived from a branched, primary, alcohol the ratios become 1000:1 to 50:1. When the monoester is derived from a linear, secondary, alcohol the ratios become 600:1 to 150:1. All of these maxima are greatly in excess of the ratios disclosed in our earlier application. It is surprising that monoesters from linear primary alcohols, known to be antifoams and ineffective anti-resoiling agents in presence of hardness ions, even at pH5 should be effective in the compositions of the present invention.

Compositions of the present invention are typically 30–45% total active detergent of which 15–35% is a calcium/magnesium sensitive anionic synthetic detergent, 5–20% total solubiliser, 0.02–0.1 monoester and 1–5% pH controller, pH of compositions 4.5–6. These may be used as a conventional dishwashing composition, viz ~ 500 times dilution and as a way of obtaining an anti-resoiling effect in the high concentration usage. In the high concentrated usage, the concentration of monoester is effective at 0.001% and the success of such a low ester content is surprising, in presence of a high level of the other active detergent, and low level of water.

Above certain levels of alkyl phosphate monoester in compositions, the antifoaming effects increase to such proportions as to reduce the foam performance of the compositions in dilute solution (~ 0.1–0.2% by weight), particularly in hard water, to levels which are unacceptable to consumers. The criticalities in content of alkyl phosphate monoester and in the relationship with the anionic synthetic detergent are demonstrated in the Examples.

It will be appreciated that the nature of the soil in the dirty pan during treatment will have to a certain extent an effect upon the anti-resoiling efficiency of the washing solution. Proteinaceous foods e.g. e.g., milk, interfere to a slightly greater extent than fatty or farinaceous matter. The latter foods hardly interfere at all, unless they are present in unreasonably high quantities, and are comparable in their effect to an essentially clean pan. When proteinaceous food soils are consistently encountered it is desirable to employ maxima ratios of total anionic synthetic detergent plus anionic solubiliser to alkyl phosphate monoester, of the order of 1200:1, 800:1 and 450:1, respectively.

The compositions may include a balance of inert filler, e.g. sodium sulphate, polyethylene glycol, for powdered or paste compositions, or water, hydrotropes, viscosity modifiers, opacifiers etc. for liquid compositions. All may contain perfume, colourants, fruit juices etc.

The invention will now be described by way of Examples in which the amounts of phosphate monoester are expressed in terms of the commercial material. The actual content of the specified alkyl phosphate monoester is given.

| | Example No. 1 | 2 | 3 | 4 | 5 | 6 | 7 |
|---|---|---|---|---|---|---|---|
| | % by weight | | | | | | |
| Ca/Mg sensitive anionic synthetic detergent (ASD) | | | | | | | |
| Sodium dodecyl benzene sulphonate | — | 30 | — | — | 19 | 20 | 29 |
| Sodium $C_{13}$-$C_{15}$ secondary alkane sulphonate | 30 | — | — | 32 | — | — | — |
| Sodium $C_{11}$-$C_{16}$ alkene 1-sulphonate* | — | — | 23.5 | — | — | — | — |
| Anionic solubiliser | | | | | | | |
| Ammonium $C_{12}$-$C_{15}$ primary alcohol $\overline{3}$EO sulphate | 8 | 8 | — | — | 19 | — | 8 |
| Sodium $C_{14-16}$ 3/4 hydroxy alkane sulphonate and disulphonate* | — | — | 15.5 | — | — | — | — |
| Nonionic solubiliser | | | | | | | |
| $C_{11}$-$C_{15}$ secondary alcohol $\overline{12}$EO | — | — | — | 8 | — | 5 | — |
| Anti-resoiling agent (ARA) | | | | | | | |
| $C_{11}$-$C_{15}$ secondary alcohol $\overline{3}$EO phosphate (5% monoester of the invention) | 1.8 | — | — | — | — | — | — |
| Lauryl phosphate (12% monoester of the invention) | — | 0.5 | — | 0.3 | — | — | 0.25 |
| $C_{12}$-$C_{15}$ synthetic (branched/linear) primary alcohol phosphate (50% monoester of the invention) | — | — | 0.15 | — | 0.1 | 0.05 | — |
| pH controller | | | | | | | |
| Succinic acid | 2.5 | 1.5 | — | — | 2.0 | — | 5.0 |
| Glutaric acid | — | 1.0 | — | — | 2.0 | — | — |
| Citric acid | — | — | 1.0 | 5.0 | — | 1.0 | — |
| $NH_4OH$ to pH | (4.9) | (5.0) | (5.0) | (6.0) | (5.0) | (6.5) | (4.8) |
| Hydrotrope | | | | | | | |
| Ethanol | 6 | 6 | 9 | 5 | 6 | 3 | 5 |
| Urea | — | 6 | — | — | — | 1 | — |
| Gelatin | 1.5 | — | — | 2.0 | 1.0 | — | 1.5 |
| Water | ← | | | to 100% | | | → |
| Anti-resoiling test (30% in 18°H water) No. cook/wash cycles | 1 | 1 | 1 | 1 | 1 | 2 | 1 |
| Foam test (0.06% ad in 24°H water) % | 95 | 95 | 90 | 80 | 100 | 85 | 100 |
| Foam test (0.06% ad in 4°H water) % | 100 | 90 | 85 | 80 | 100 | 75 | 80 |
| Ratio asd/ara (by weight) | 420/1 | 630/1 | 520/1 | 890/1 | 760/1 | 800/1 | 1230/1 |

* These compounds are the active detergent components of a commercially available "olefin sulphonate", containing 60% alkene-1-sulphonate and 40% 3/4-hydroxy and di-sulphonate mix.

The following Examples 8–14 demonstrate the minimum concentration of alkyl phosphate monoester critical for anti-resoiling effect, viz. an anti-resoiling score on the test hereindescribed of 3 cycles. A standard dishwashing liquid was prepared to the following composition:

| | |
|---|---|
| Sodium dodecyl benzene sulphonate | 30% |
| Ammonium $C_{12}$-$C_{15}$ primary alcohol $\overline{3}$EO sulphate | 8% |
| Succinic acid | 2.5% |
| $NH_4OH$ to pH | (5)% |
| Anti-resoiling agent) | |
| Hydrotrope (alcohol) | |
| Water | to 100% |

| Ex No | Source of "alkyl" | Content of monoalkyl phosphate/monoalkyl phosphate-1 ethylene oxide adduct (%) | MEC (expr on material used) | Calculated MEC* | Ratio ASD:ARA |
|---|---|---|---|---|---|
| 8 | Commercial lauryl alcohol ($C_{12}$) | 12 | 0.25 | 0.03 | 1250/1 |
| 9 | $C_{12}$ linear primary | 100 | 0.03 | 0.03 | 1250/1 |
| 10 | $C_{11}$ linear primary | 100 | 0.025 | 0.025 | 1500/1 |
| 11 | $C_{13-15}$ linear/branched (50/50) primary $\overline{3}$EO | 15 | 0.30 | 0.045 | 900/1 |
| 12 | $C_{11-15}$ linear secondary $\overline{3}$EO | 5 | 1.25 | 0.0625 | 600/1 |
| 13 | $C_{13-15}$ linear/branched (50/50) primary | 50 | 0.085 | 0.042 | 900/1 |
| 14 | $C_{12-15}$ linear/branched | 60 | 0.065 | 0.039 | 1000/1 |

-continued

| Ex No | Source of "alkyl" | Content of monoalkyl phosphate/monoalkyl phosphate-1 ethylene oxide adduct (%) | MEC (expr on material used) | Calculated MEC* | Ratio ASD:ARA |
|---|---|---|---|---|---|
| | (75/25) primary | | | | |

*Calculated MEC is the minimum effective concentration of the ester to give the anti-resoiling score of 3 cycles, expressed in terms of 100% monoester (and/or monoethoxylated monoester). Below this concentration, the anti-resoiling effect is not attained.

The above results show that the esters derived from linear primary alcohols are superior to those from branched primary alcohols which are superior to those from linear secondary alcohols.

For completeness, Examples 7–15 include their calculated ratios of ASD (i.e. anionic synthetic detergent, including anionic solubiliser) to ARA (viz. anti-resoiling agent). These are believed to be critical for performance in respect of foam and anti-resoiling effect.

The following Examples 15–20 demonstrate the criticality in the ratio of anionic synthetic detergent to anti-resoiling agent if foam to the extent of 60% of the premium product hereindescribed is to be obtained. The ester was included in the standard dishwashing liquid of Examples 7–14.

| Ex No | Source of "alkyl" | Content of monoalkyl phosphate/monoalkyl phosphate-1 ethylene oxide adduct (%) | Liquid amount used % | Foam score % | Ratio ASD:ARA |
|---|---|---|---|---|---|
| 15 | $C_{11-15}$ linear, secondary −3 ethylene oxide adduct alcohol | 5 | 1.5 | 90 | 500/1 |
| 16 | " | 5 | 4.5 | 62 | 170/1 |
| A | " | 5 | 6.0 | 50 | 127/1 |
| 17 | $C_{13-15}$ linear/branched primary (50/50) −3 ethylene oxide adduct alcohol | 15 | 0.5 | 95 | 500/1 |
| 18 | " | 15 | 5.0 | 65 | 50/1 |
| B | " | 15 | 6.0 | 45 | 41/1 |
| 19 | $C_{12-14}$ linear, primary alcohol | 50 | 0.075 | 98 | 1000/1 |
| 20 | " | 50 | 2.5 | 61 | 30/1 |
| C | " | 50 | 4.0 | 48 | 19/1 |

The above compositions A, B and C lie outside the invention, and are included as comparatives.
Solution pH's (24°H temporary hardness) at 0.15% composition by weight were 7 ± 0.3.

Example 21

A dishwashing powder of the following composition was made up by the process described below:

| | % |
|---|---|
| Sodium $C_{14-16}$ "olefin sulphonate" (60% alkene 1-sulphonate 40% alkane 3/4 —OH and disulphonate) | 30 |
| $C_{13}$–$C_{15}$ synthetic primary alcohol phosphate (40% monoester phosphate) | 0.1 |
| Benzoic acid | 2 |
| Sodium sulphate | 67 |
| Ratios | |
| Total of anionic synthetic detergent and anionic solubiliser to phosphate monoester | 750/1 |
| Performance | |
| Foam, 0.06% ad, 24°H water | 75 |
| Anti-resoiling, 30% 24°H water | 1 cycle |

The liquid anti-resoiling agent is absorbed on sodium sulphate and dry mixed with the crystalline acid and drum dried olefin sulphonate flake.

The foregoing detergent compositions may be made into pastes suitable for injection or inclusion in steel wool, woven or non-woven nylon fleeces with polishing or abrasive properties, for use as scouring or washing-up pads. Pastes with satisfactory bulk solubility characteristics may be made with the aid of fillers for example sodium sulphate, high molecular weight polyethylene glycol, fine mineral silicas, of felspars and foam boosters such as lauric diethanolamide. In use in the scouring operation, adequate foam and the defined anti-resoiling effects are attained.

Detergent bars of similar compositions may be made for markets which desire this particular product form.

We claim:

1. In a liquid hand dishwashing composition of the type having a pH of not more than 7 and comprising from about 10 to about 50% by weight of a detergent active compound from 5 to 40% by weight of which is a calcium/magnesium sensitive anionic synthetic detergent selected from the group consisting essentially of $C_{11-18}$ $\alpha$ and random alkene sulphonates, random $C_{13-18}$ alkane sulphonates, $C_{10}$–$C_{15}$ alkyl benzene sulphonates, $C_{11}$–$C_{15}$ primary and secondary alcohol sulphates and mixtures thereof, and water the improvement which comprises in incorporating in the composition from 0.01 to 2% by weight of a phosphate monoester having the general formulae

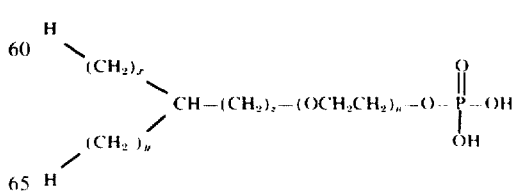

(I)

wherein $x + y + z$ is from 9–17 and one of $x$, $y$ and $z$ may be zero, and $n$ is zero or 1, (ii)

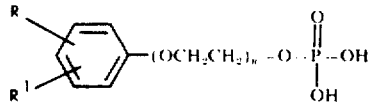

wherein R and $R^1$ are $C_8$–$C_{18}$ alkyl groups and one of R and $R^1$ may be hydrogen,

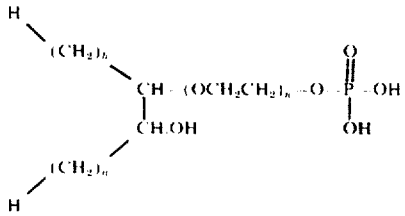

(iii)

where $a + b$ is from 10–16 and one of $a$ and $b$ may be zero and $n$ is zero or 1, and (iv) analogues of said esters having the formulae (i), (ii) and (iii), the alkyl groups being substituted by alkenyl groups, and from 1 to 40% by weight of a nonionic or anionic solubilizer, a 0.05% aqueous solution of which will remain clear at 24°H of hardness and neutral pH at temperatures of from 20°–45°C the ratio of the total amount of detergent active compound and solubilizer to the amount of phosphate monoester in the composition being from 1500:1 to 30:1 when the phosphate monoester is derived from a linear primary alcohol, from 1000:1 to 50:1 when the phosphate monoester is derived from a branched chain primary alcohol, and from 600:1 to 150:1 when the phosphate monoester is derived from a linear secondary alcohol.

2. A dishwashing composition according to claim 1 wherein the alkyl phosphate ester is in the form of a sodium, potassium or ammonium half salt.

3. A dishwashing composition according to claim 1 comprising from 0.02 to 0.1% by weight of the phosphate monoester.

4. A dishwashing composition according to claim 1 comprising from 0.5 to 5% by weight of an acid pH controller having a pKa in the range of 3–6.

5. A dishwashing composition according to claim 4 wherein the pH controller is selected from the group consisting of malonic, succinic, glutaric, citric, tartaric and lactic acid, and mixtures thereof.

6. A dishwashing composition according to claim 4 wherein the pH controller is selected from the group consisting of phthalic, adipic, fumaric and benzoic acid, and mixtures thereof.

* * * * *